US007971381B1

(12) United States Patent
Mikell

(10) Patent No.: US 7,971,381 B1
(45) Date of Patent: Jul. 5, 2011

(54) HANDGUN SAFETY APPARATUS

(76) Inventor: Larric D. Mikell, Las Vegas, NV (US)

( * ) Notice: Subject to any disclaimer, the term of this patent is extended or adjusted under 35 U.S.C. 154(b) by 203 days.

(21) Appl. No.: 12/473,984

(22) Filed: May 28, 2009

(51) Int. Cl.
*F41A 17/00* (2006.01)

(52) U.S. Cl. ..... 42/70.11

(58) Field of Classification Search ..... 42/70.11, 42/70.07

See application file for complete search history.

(56) References Cited

U.S. PATENT DOCUMENTS

| | | | | | |
|---|---|---|---|---|---|
| 835,349 | A | * | 11/1906 | Deming | 42/70.08 |
| 4,378,082 | A | * | 3/1983 | Chica | 224/243 |
| 4,392,318 | A | | 7/1983 | Daniels | |
| 4,395,837 | A | | 8/1983 | Durnal | |
| 4,412,397 | A | * | 11/1983 | Bayn | 42/70.11 |
| 4,569,144 | A | * | 2/1986 | Thurber | 42/70.11 |
| 4,934,083 | A | | 6/1990 | Smith | |
| 4,961,277 | A | * | 10/1990 | Rosenbaum | 42/70.11 |
| 5,099,596 | A | * | 3/1992 | Butler, Jr. | 42/70.11 |
| 5,261,177 | A | | 11/1993 | Armstrong | |
| 5,446,988 | A | * | 9/1995 | Frederick, Jr. | 42/70.11 |
| D392,364 | S | | 3/1998 | Neal et al. | |
| 5,768,819 | A | | 6/1998 | Neal | |
| 5,913,666 | A | * | 6/1999 | Perkins | 42/70.11 |
| 6,568,117 | B2 | * | 5/2003 | Weinraub | 42/70.11 |
| 6,604,657 | B2 | * | 8/2003 | Yirmiyahu et al. | 224/243 |
| 2003/0066228 | A1 | | 4/2003 | Smith | |

* cited by examiner

*Primary Examiner* — Michael Carone
*Assistant Examiner* — Joshua Freeman
(74) *Attorney, Agent, or Firm* — Crossley Patent Law; Mark A. Crossley

(57) ABSTRACT

The handgun safety apparatus provides a pair of loops, each of which wraps around a semiautomatic handgun so that the barrel/receiver, also sometimes referred to as the slide, and the trigger are prevented from operation. Even if a round is in the chamber of the handgun, the trigger cannot be operated. Further, the slide cannot operate to chamber a round, so the apparatus provides twofold safety. The apparatus is provided in a variety of sizes to fit a variety of handguns. Each of the loops has a rigid insert that provides rigidity. The inside of each loop is made of a material that will not mar the handgun in any way. The straps do not infringe upon the grip.

2 Claims, 3 Drawing Sheets

HANDGUN SAFETY APPARATUS

BACKGROUND OF THE INVENTION

Enabling and encouraging gun safety includes devices that prevent firearm loading, cocking, and firing. Devices for handguns typically are more specialized than simply devices for safety of all guns. Of those devices, trigger locks alone have proven to be inadequate in many situations and with many of the various handguns. Cables that invade the barrel/receiver, also sometimes called the slide, have encountered dislike among users for various reasons, including leaving a handgun open to the elements and potential marring of the gun. Devices incorporated into a handgun's manufacture disregard the millions of handguns already in use. Therefore, there remains area for improvement. There present apparatus provides a unique means for securing a semiautomatic handgun against tampering, loading, and firing, without damage to the firearm and without coverage of the grip or significant coverage of the frame.

FIELD OF THE INVENTION

The handgun safety apparatus relates to safety devices for handguns and more especially to a safety apparatus for a semiautomatic handgun.

SUMMARY OF THE INVENTION

The general purpose of the handgun safety apparatus, described subsequently in greater detail, is to provide a handgun safety apparatus which has many novel features that result in an improved handgun safety apparatus which is not anticipated, rendered obvious, suggested, or even implied by prior art, either alone or in combination thereof.

To attain this, the handgun safety apparatus provides a pair of loops, each of which wraps around a semiautomatic handgun so that the barrel/receiver, also sometimes referred to as the slide, and the trigger are prevented from operation. Even if a round is in the chamber of the handgun, the trigger cannot be operated. Further, the slide cannot operate to chamber a round, so the apparatus provides twofold safety. The apparatus is provided in a variety of sizes to fit a variety of handguns. Each of the loops has a rigid insert that provides rigidity. The inside of each loop is made of a material that will not mar the handgun in any way. Leather, vinyl, cloth, and a variety of other non-abrasive materials can be chosen. The rigid inserts are made of steel, laminates, composites, a para-aramid synthetic fiber, and a variety of other appropriate materials for providing loop rigidity.

The keyed two-segment lock provides security against inadvertent removal of the apparatus. The lock provides a male segment on one strap that locks within a female segment on the other strap.

Thus has been broadly outlined the more important features of the improved handgun safety apparatus so that the detailed description thereof that follows may be better understood and in order that the present contribution to the art may be better appreciated.

An object of the handgun safety apparatus is to provide twofold safety measures for a semiautomatic handgun.

Another object of the handgun safety apparatus is to prevent slide action.

A further object of the handgun safety apparatus is to prevent trigger operation.

An added object of the handgun safety apparatus is to lock against inadvertent or unintended removal.

And, an object of the handgun safety apparatus is to prevent any marring of the handgun.

Another object of the handgun safety apparatus is to negate coverage of the grip so that the handgun can be properly handled and still ensure safety.

These together with additional objects, features and advantages of the improved handgun safety apparatus will be readily apparent to those of ordinary skill in the art upon reading the following detailed description of presently preferred, but nonetheless illustrative, embodiments of the improved handgun safety apparatus when taken in conjunction with the accompanying drawings.

In this respect, before explaining the current embodiments of the improved handgun safety apparatus in detail, it is to be understood that the handgun safety apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved handgun safety apparatus. It is therefore important that the claims be regarded as including such equivalent constructions insofar as they do not depart from the spirit and scope of the handgun safety apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 4 thereof, the principles and concepts of the handgun safety apparatus generally designated by the reference number 10 will be described.

Figure 1:
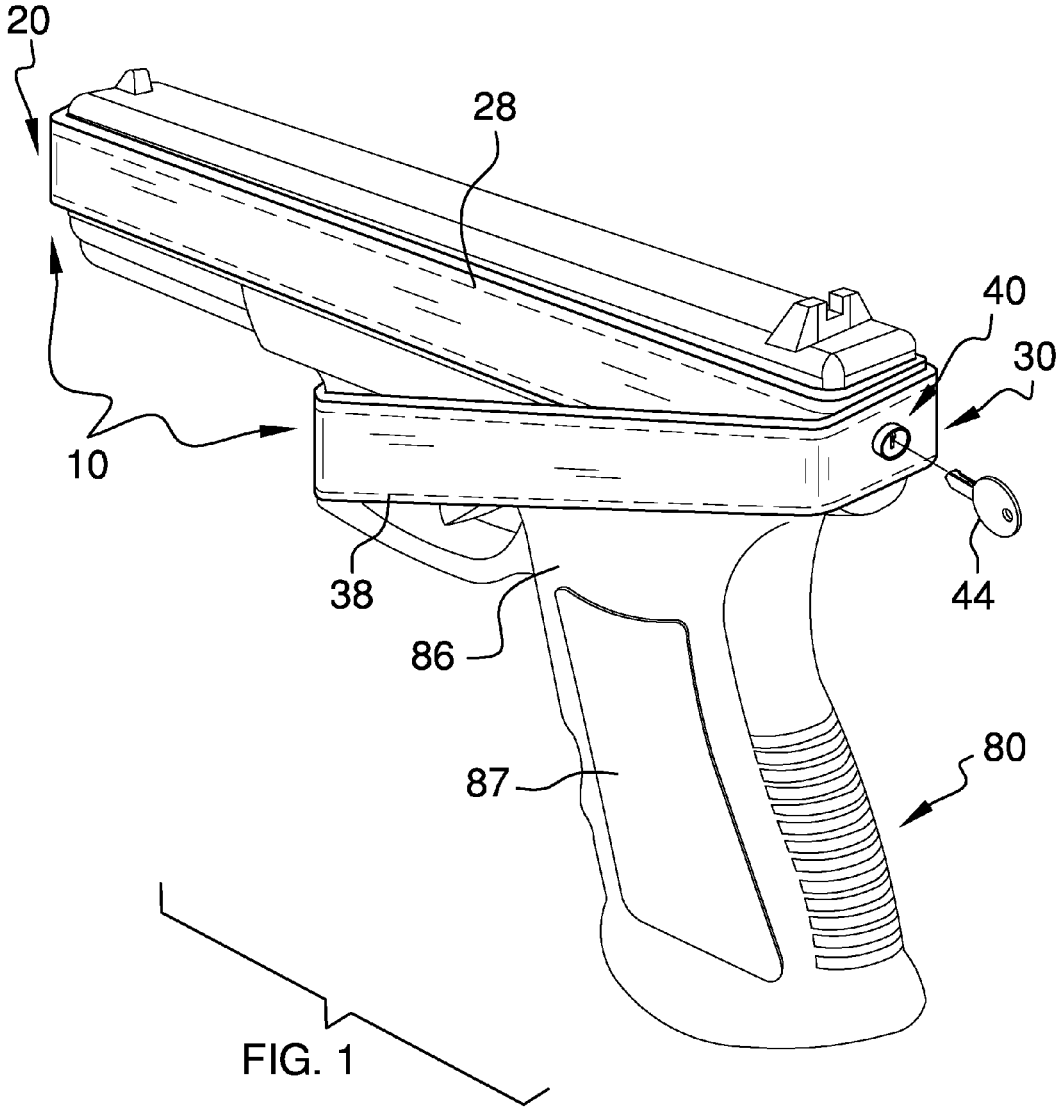
FIG. 1 is a perspective view of the apparatus in use.
Figure 3:
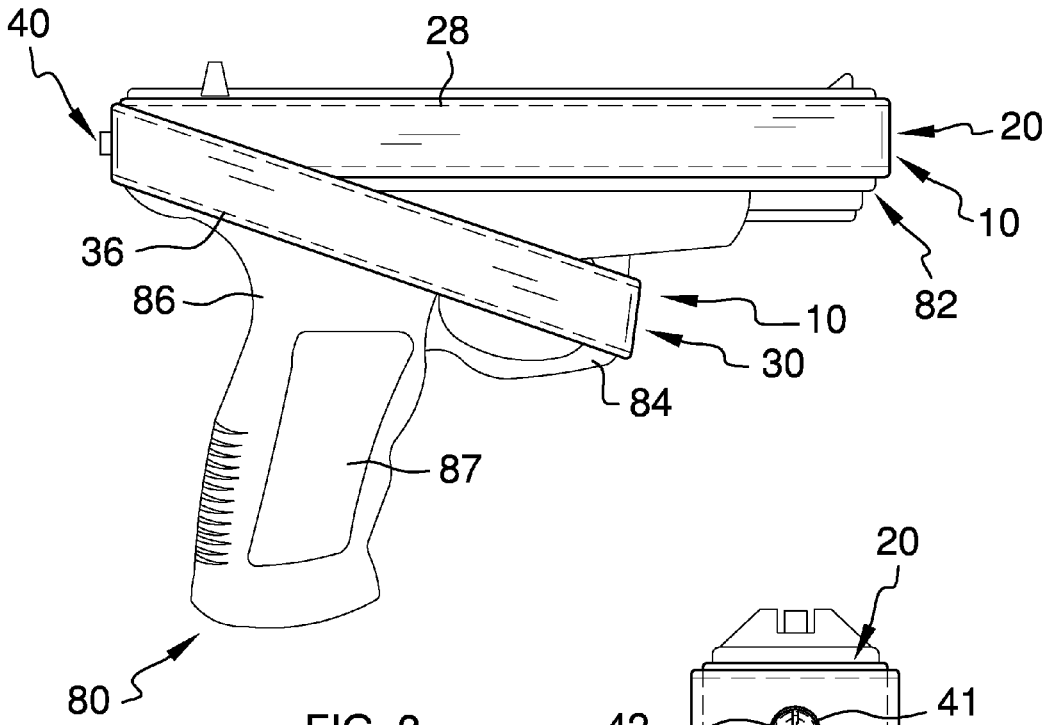
FIG. 3 is a lateral elevation view of the apparatus in use.

Referring to FIGS. 1 and 3, the handgun safety apparatus 10 provides a pair of separate non-abrasive parallelepiped straps selectively installed on an existing semiautomatic handgun 80. The first strap 20 removably installs around the barrel/receiver 82 of the handgun 80. The second strap removably installs around the rear of the barrel/receiver 82 and further loops around the trigger guard 84. The straps are of non-abrasive material, both on an inner surface and an outer surface of each strap so that no abrasion or marring of the handgun 80 can occur. No movement occurs between the straps and the handgun 80, so even further insurance against abrasion and wear is guaranteed. The frame 86 of the handgun 80 is only slightly encroached upon, only by the second strap 30. The grip 87 is untouched, so there exists no opportunity of marring any grip 87, especially those that are customized or of exotic materials.

Figure 2:
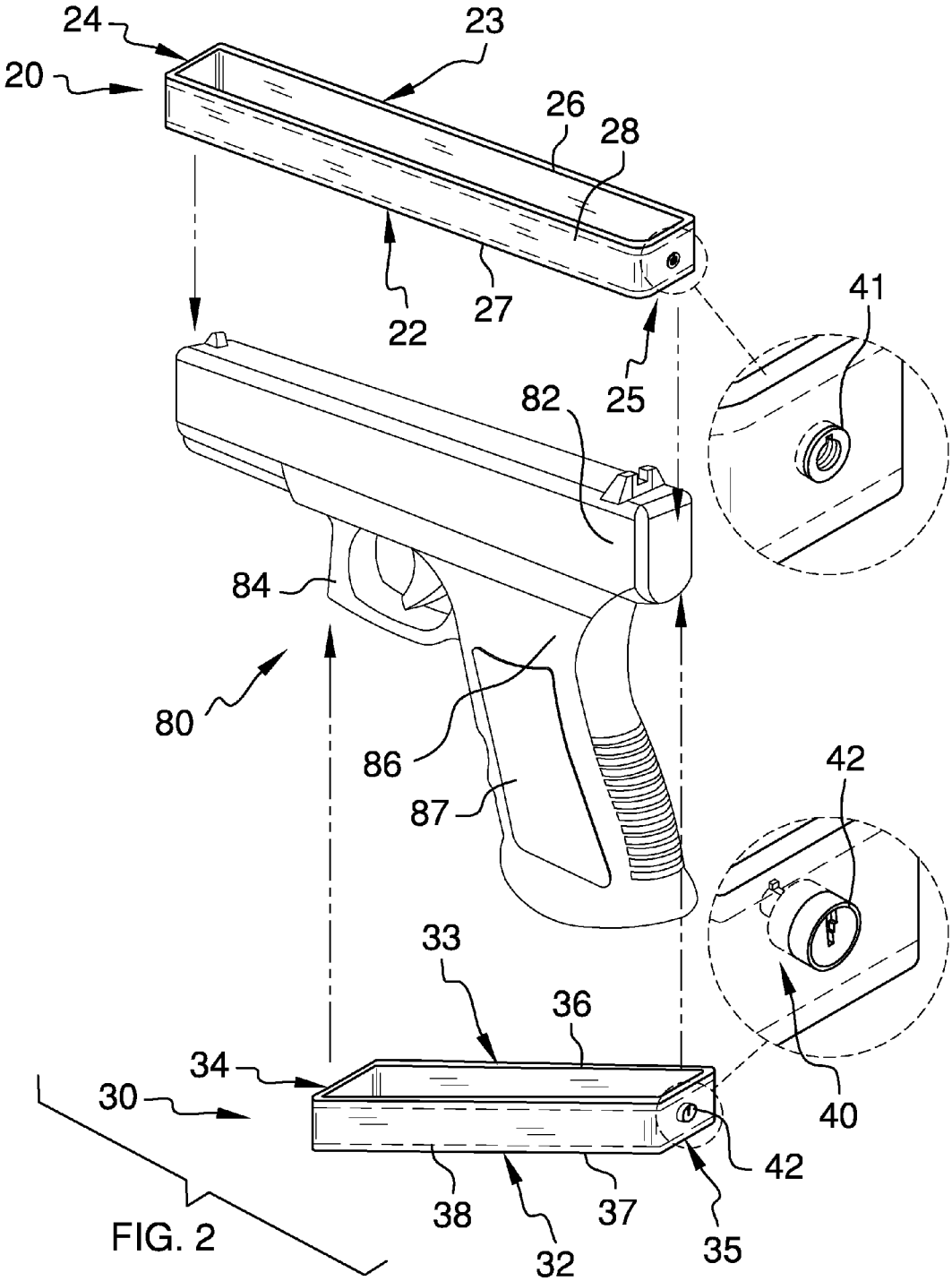
FIG. 2 is a perspective view of the apparatus removed from the handgun.
Figure 4:
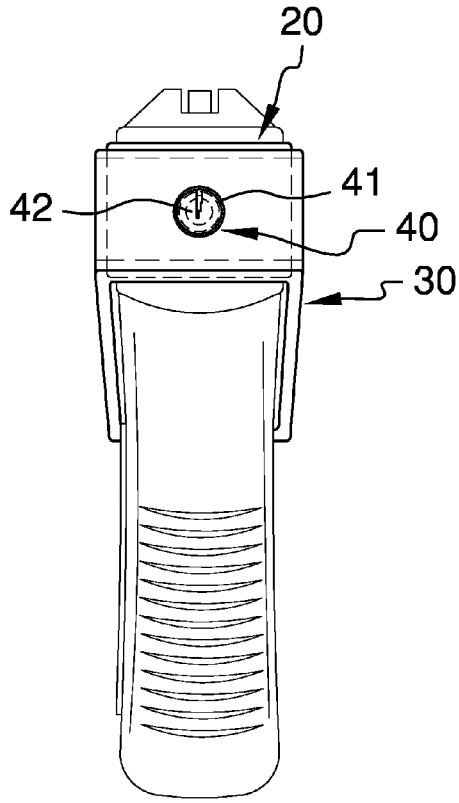
FIG. 4 is a rear elevation view of the apparatus in use.

Referring to FIGS. 2 and 4, the apparatus 10 partially comprises the first strap 20 selectively installed and removed from around the barrel/receiver 82. The first strap 20 has a top 26 spaced apart from a bottom 27, a first side 22 spaced apart from a second side 23, and a first end 24 spaced apart from a second end 25. A rigid insert 28 is disposed throughout the interior of the first strap 20.

The insert 28 is throughout the first strap 20 and is extended from proximal to the top 26 to proximal to the bottom 27. The female segment 41 of the lock 40 is disposed within the second end 25. The second strap 30 is installed around the rear of the barrel/receiver 82 and the trigger guard 84 of the handgun 80. The second strap 30 has a loop first side 32 spaced apart from a loop second side 33. The second strap 30 further comprises a loop top 36 spaced apart from the loop bottom 37. The second strap 30 also comprises a loop first end 34 spaced apart from a loop second end 35. The rigid loop insert 38 is disposed inside the second strap 30. The loop insert 38 extends from proximal to the loop top 36 to proximal to the loop bottom 37. The male segment 42 of the lock 40 is disposed within the loop second end 35 of the second strap 30. The male segment 42 is selectively joined to the female segment 41 of the first strap 20. The key 44 selectively releases the male segment 42 from the female segment 41, allowing removal of the apparatus 10.

With respect to the above description then, it is to be realized that the optimum dimensional relationships for the parts of the handgun safety apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the handgun safety apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the handgun safety apparatus may be used.

Therefore, the foregoing is considered as illustrative only of the principles of the handgun safety apparatus. Further, since numerous modifications and changes will readily occur to those skilled in the art, it is not desired to limit the handgun safety apparatus to the exact construction and operation shown and described, and accordingly, all suitable modifications and equivalents may be resorted to, falling within the scope of the handgun safety apparatus.

What is claimed is:

1. A handgun safety apparatus, comprising, in combination:

a pair of separate non-abrasive parallelepiped straps selectively installed on an existing semiautomatic handgun, the straps comprising:

a first strap installed around a barrel/receiver of the handgun, the first strap having a top spaced apart from a bottom, a first side spaced apart from a second side, a first end spaced apart from a second end;

a second strap installed around a rear of the barrel/receiver and a trigger guard of the handgun, the second strap having a loop first side spaced apart from a loop second side, a loop top spaced apart from a loop bottom, a loop first end spaced apart from a loop second end;

a lock selectively locking the first strap to the second strap;

wherein the lock further comprises a keyed lock;

wherein the keyed lock further comprises a male segment of the lock disposed within the loop second end, the male segment selectively joined to a female segment of the first strap disposed within the first strap second end.

2. A handgun safety apparatus, comprising, in combination:

a pair of separate non-abrasive parallelepiped straps selectively installed on an existing semiautomatic handgun, the straps comprising:

a first strap installed around a barrel/receiver of the handgun, the first strap having a top spaced apart from a bottom, a first side spaced apart from a second side, a first end spaced apart from a second end;

a rigid insert disposed an interior of the first strap, the insert extended from proximal to the top to proximal to the bottom;

a female segment of a lock disposed within the second end of the first strap;

a second strap installed around a rear of the barrel/receiver and a trigger guard of the handgun, the second strap having a loop first side spaced apart from a loop second side, a loop top spaced apart from a loop bottom, a loop first end spaced part from a loop second end;

a rigid loop insert disposed throughout an interior of the second strap, the loop insert extended from proximal to the loop top to proximal to the loop bottom;

a male segment of a lock disposed within the loop second end of the second strap, the male segment selectively joined to the female segment of a lock, a lock selectively securing the first strap to the second strap around the handgun;

a key selectively releasing the male segment from the female segment.

* * * * *